US009759052B2

(12) United States Patent
Hutchins et al.

(10) Patent No.: US 9,759,052 B2
(45) Date of Patent: Sep. 12, 2017

(54) SWELLABLE POLYMER PARTICLES FOR PRODUCING WELL TREATMENTS

(71) Applicant: SCHLUMBERGER TECHNOLOGY CORPORATION, Sugar Land, TX (US)

(72) Inventors: Richard Hutchins, Sugar Land, TX (US); Syed A. Ali, Sugar Land, TX (US); Yenny Christanti, Houston, TX (US); Manuel Jose Lastre Buelvas, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 61 days.

(21) Appl. No.: 14/557,724

(22) Filed: Dec. 2, 2014

(65) Prior Publication Data

US 2015/0152317 A1 Jun. 4, 2015

Related U.S. Application Data

(60) Provisional application No. 61/911,812, filed on Dec. 4, 2013.

(51) Int. Cl.
*C09K 8/60* (2006.01)
*E21B 43/16* (2006.01)

(52) U.S. Cl.
CPC ..... *E21B 43/162* (2013.01)

(58) Field of Classification Search
None
See application file for complete search history.

(56) References Cited

U.S. PATENT DOCUMENTS

| | | | | |
|---|---|---|---|---|
| 5,662,168 | A * | 9/1997 | Smith | C07C 51/412 166/295 |
| 5,726,138 | A | 3/1998 | Tsaur et al. | |
| 6,364,016 | B1 * | 4/2002 | Dalrymple | C09K 8/508 166/270 |
| 6,476,169 | B1 * | 11/2002 | Eoff | C09K 8/5083 526/259 |
| 7,169,427 | B2 | 1/2007 | Frith et al. | |
| 7,182,136 | B2 * | 2/2007 | Dalrymple | C09K 8/68 166/281 |
| 7,552,771 | B2 * | 6/2009 | Eoff | C09K 8/5083 166/279 |
| 2005/0000694 | A1 * | 1/2005 | Dalrymple | C09K 8/68 166/307 |
| 2005/0042192 | A1 | 2/2005 | Evans et al. | |
| 2007/0204989 | A1 | 9/2007 | Tang | |

* cited by examiner

*Primary Examiner* — John J Figueroa
(74) *Attorney, Agent, or Firm* — Andrea E. Tran

(57) ABSTRACT

A method of treating a producing well that includes the introduction of a treatment fluid to the producing well from a surface above the subterranean formation, the treatment fluid comprised of at least PPG particles to enhance the oil rate and reduce the water rate of the producing well.

10 Claims, 1 Drawing Sheet

SWELLABLE POLYMER PARTICLES FOR PRODUCING WELL TREATMENTS

CROSS-REFERENCE TO RELATED APPLICATION

This application claims the benefit of U.S. Provisional Application Ser. No. 61/911,812 filed Dec. 4, 2013 entitled "Swellable Polymer Particles for Producing Well Treatments" to Hutchins et al., the disclosure of the provisional application is incorporated by reference herein in its entirety.

BACKGROUND

Oil and gas reservoirs do not often contain homogeneous geologic properties (e.g. porosity and permeability). For many of such reservoirs, the differences in the permeability (ability to allow fluid flow) among the different geologic layers can vary as much as several orders of magnitude.

In the case of an oil production well, a fluid within the subterranean formation (e.g., aquifer), pressurizes the oil and gas and drives some of the oil in place to a nearby production well where the oil and fluid are co-produced. Permeability (a property that measures the ability to transmit flow) may vary greatly among the geologic layers of rock that contain oil within its porous spaces in the subsurface reservoir. Such a wide variation may cause the fluid drive to be non-uniform, such that the larger amount of fluid may enter the higher permeability geologic layers. As a result, the reservoir may be characterized by the very non-uniform displacement of the oil within the reservoir, with most of the oil being quickly mobilized from high permeability layers. This may leave the oil within the lower permeability layers virtually undisturbed, and result in the fluid exiting production wells having a high water to oil ratio (WOR). In other words, a large amount of water exiting from the production well directly correlates to a decreased amount of oil exiting from the same well, which translates to a well that is not optimized for maximum production and/or is considered not economically feasible.

A production well or producer is a well from which reservoir fluids are extracted to a surface facility. Typically the facility is a series of separators or equipment designed to produce three relatively pure streams of gas, oil, and brine, which are then sent for further processing or directly enter pipelines, storage tanks, disposal/injection wells, or to a flare. Sediment and various undesirable mixtures of solids, oil, and brine normally accumulate at the bottom of a separator and are removed periodically. The well can be cased and cemented with access to the reservoir zones by perforations or an openhole completion where no pipe is used. Alternative completions such as slotted liners or gravel packs are also possible. Typically, the fluids entering the production well will be a mixture of hydrocarbon (gas, oil, condensate or mixtures) and brine. The initial brine is normally the connate brine in the reservoir, but as either injected fluid or aquifer fluid encroaches into the reservoir, the produced brine composition will be a mixture of the various brines present in the reservoir. When either injection fluid or aquifer brine break through at the producer, the produced oil rate declines and the brine rate increases. Some reservoirs will include pattern injection wells as well as have aquifer influx while other wells may either have only pressure support from an aquifer or from injection wells. Both scenarios are included in FIG. 1 for clarity. The subject matter of the present application is strictly limited to injection of a treating fluid into producing wells and not into an injection well as a remedial treatment for reducing the WOR. The treating fluids are typically added into a surface line connecting to the wellhead of the producing well, although some wells have their wellhead on the seafloor and require a different pathway for the injected fluids. Injection can be done into the production tubing, coiled tubing that is in the wellbore and concentric with the tubing, or into a live annulus with a largely unrestricted fluid pathway to the zone of interest.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Disclosures relate to compositions and methods for treating subterranean formations, in particular, oilfield production treatment compositions and methods using preformed particle gels (also referred to herein as "PPG").

In some embodiments, the present disclosure relates to a method of treating a producing well that includes the introduction of a treatment fluid to the producing well from a surface of the subterranean formation, the treatment fluid comprised of at least PPG particles to enhance the oil rate and reduce the water rate of the producing well.

DETAILED DESCRIPTION

Figure 1:
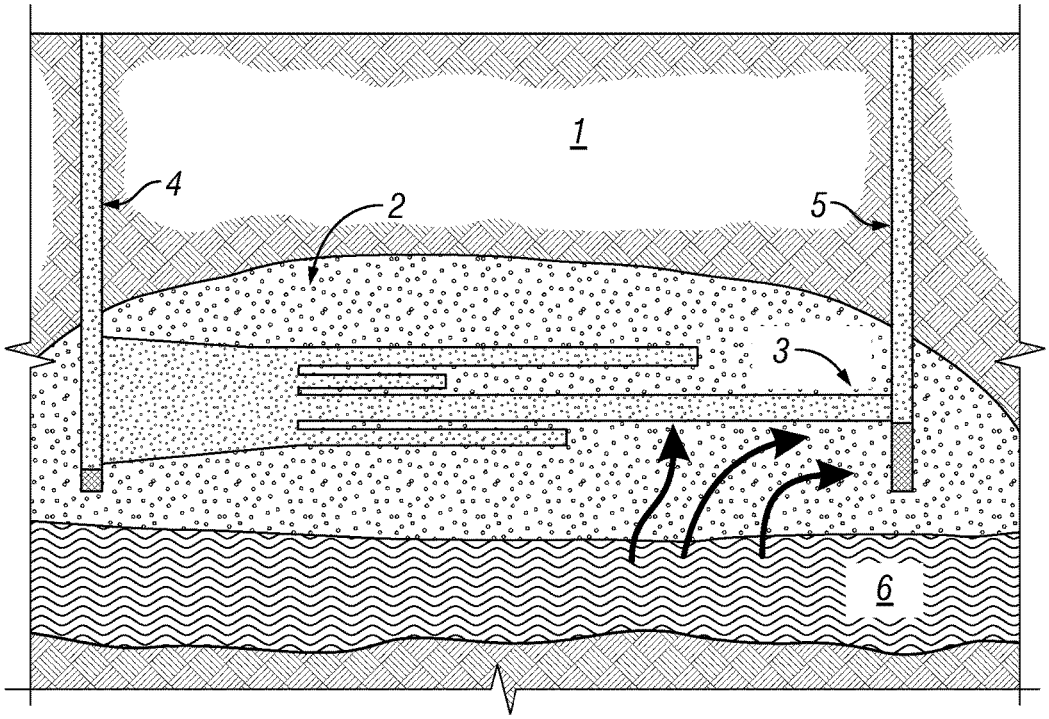
FIG. 1 is a schematic of a reservoir with injection and production wells and illustrates some scenarios of flow of water in the reservoir.

At the outset, it should be noted that in the development of any such actual embodiment, numerous implementation—specific decisions may be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary and this detailed description, each numerical value should be read once as modified by the term "about" (unless already expressly so modified), and then read again as not so modified unless otherwise indicated in context. Also, in the summary and this detailed description, it should be understood that a range listed or described as being useful, suitable, or the like, is intended to include support for any conceivable sub-range within the range at least because every point within the range, including the end points, is to be considered as having been stated. For example, "a range of from 1 to 10" is to be read as indicating each possible number along the continuum between about 1 and about 10. Furthermore, one or more of the data points in the present examples may be combined together, or may be combined with one of the data points in the specification to create a range, and thus include each possible value or number within this range. Thus, (1) even if numerous specific data points within the range are explicitly identified, (2) even if reference is made to a few specific data points within the range, or (3) even when no data points within the range are explicitly identified, it is to be understood (i) that the inventors appreciate and understand that any conceivable data point within the range is to be considered to have been specified, and (ii) that the inventors possessed knowledge of the entire range, each conceivable sub-range within the range, and each conceivable point within the range. Furthermore, the subject matter of this application illustratively disclosed herein suitably may be practiced in the absence of any element(s) that are not specifically disclosed herein.

The statements made herein merely provide information related to the present disclosure and may not constitute prior art, and may describe some embodiments illustrating aspects of the disclosure.

For the purpose of this application, the term "treatment fluid" or "treating fluid" is defined as a fluid containing PPG. It may optionally include salt (a "brine"), a relative permeability modifier (RPM), crosslinkers for the RPM or the PPG, water or non-aqueous carrier fluid. The treating fluid may further include suspending agents such as various polymers (for either aqueous or non-aqueous suspensions) or organophilic clays (for non-aqueous suspensions only).

Disclosures relate to compositions and methods for treating producing (or production) wells by introducing or injecting one or more preformed particle gels into the producing well to enhance the oil production rate and reduce the water rate (i.e., reducing the water to oil ratio (WOR) exiting the producing well during normal operations).

Preformed particles gels (or PPG) are described in U.S. Patent Application 2007/0204989, the disclosure of which is incorporated by reference herein in its entirety. This application describes the application of PPG particles to injection well treatments. In direct contrast to producing well, an injection well or injector is a well where fluid is injected into the reservoir for maintaining pressure and sweeping hydrocarbon towards the producing well or producer. Injection fluid is normally a brine such as, for example, a reservoir brine that was produced and treated before re-injection; make-up brine which can be from another source, either underground or surface; or a mixture of water sources. A diagram of an injector well is illustrated below in FIG. 1.

Referring to FIG. 1, a typical oil reservoir (1) is located under the surface of the earth and is bounded on top and on bottom by other geological formations. The reservoir undergoes water injection from the injection well (4), the aquifer (6) or both. The waterflood is done to maintain reservoir pressure which enhances the flow of fluid to the producers, avoids subsidence of the reservoir, and helps displace oil through the reservoir. If the aquifer is strong, water injection may not be needed, but often is performed to dispose of produced water from the surface facilities. In that scenario, water disposal wells can be placed along the areal boundaries of the reservoir (peripheral injection). For the waterflooding case, injected water enters the reservoir through the completion which is designed to allow injection of fluids into the zone of interest (2) containing hydrocarbon. Various strata may exist in the reservoir and injected fluid or water from the aquifer will penetrate into the various strata at differing velocities dependent upon localized pressures, fluid saturations, and permeability to the water phase. In FIG. 1, one such stratum (3) is shown where injected water has broken through to the producing well. A similar scenario is depicted where aquifer water has also entered stratum (3) and broken through to the producing well (5). Producer well (5) allows for the extraction of fluids from the reservoir including oil, water and gas. The gas may be in solution in the oil phase and separates out as gas when the pressure is decreased in the wellbore or on surface in the separation facility or can be in the gaseous phase in the reservoir near the producing well. Fluid extraction can be enhanced by various means such as lifting equipment (downhole pumps or gas lift). As more hydrocarbon is extracted and replaced with water, the flowing fraction of oil decreases and the flowing fraction of water increases. When breakthrough of water occurs at a producer, the WOR may increase. Since the permeability for each phase depends upon the local saturation of the phase, water breakthrough results in lower hydrocarbon rates and higher water rates.

The PPG particles may be a powder product or slurry made up of a cross-linked polymer (also referred to as a super adsorbent polymer) that swells after addition to a fresh or salt water. The particle size of the PPG particles may be from about 100 micron to about 1 millimeter; such as, for example, from about 1000 microns to about 0.5 mm and from about 1000 microns to about 0.1 mm. Furthermore, the PPG particles may have a swelling ratio in formation water of from about 30 to about 200 times, based upon the original size of the PPG particles. Furthermore the PPG particles should also have a (1) stability of swelling in the presence of salt water encompassing formation brines; (2) be thermally stable (e.g., more than 1 year below 110° C. (230° F.)); and (3) a suitable strength to resist extrusion by pressure gradient in porous media (for example, 20 kPa/m to 3 MPa/m).

For their application, the PPG particles may be added to an injection line into the producing well for some period of time. The PPG suspensions can be stable and perform their desirable partial plugging action in the highest permeability zones of the reservoir at harsh reservoir conditions (up to 120° C. and in a brine containing up to 300,000 ppm total dissolved solids (TDS)). The speed of swelling and the amount of swelling may both decrease as salinity of the brine increases. For example, the swelling in fresh water could be complete in six hours and the particles will swell by a factor of 200 times the original particle volume. Conversely, in a moderate brine of 150,000 TDS, the swelling may take 20 hours and the swelling will be only 20 times the original particle volume. Highly swollen particles are more elastic and can be forced through pores substantially less than their original size while particles swollen only a moderate amount are harder, less deformable, and less likely to flow through pores smaller than the swollen particle. Brines with salinities of 10,000 mg/L or more show appreciable decrease in the rate of swelling. The reduced rate of swelling is more pronounced when divalent ions are included in the brine.

The particle concentration can be varied throughout the treatment to achieve more plugging or less, depending upon the injection pressure. The concentration can be graded from high to low to enhance deeper plugging and prevent high particle concentrations nearer to the wellbore. Smaller particles can be supplanted by injection of larger particles to enhance penetration and reduce flow nearer to the wellbore. Due to surface area, smaller particles will swell more rapidly than larger particles.

The treatment fluid may contain from about 0.2 to about 1.5 vol. % of PPG particles in the initial injection fluid stream, based upon the total volume of the initial injection fluid stream. Furthermore, the flow rate of the injection stream may be varied depending on the type of treatment desired. The present inventors believe that higher concentrations may make the pressure rise too rapidly while smaller concentrations may prove ineffective. The size and degree of swelling can be altered during injection by shifting the chemistry of the particles that are used. Injection profiles can show where the particles have diverted fluid and injectivity declines can be used to assess whether the more permeable channels and thief zones are being plugged. The volume of treatment can also be adjusted so as to achieve deep penetration but not to the extent of transporting particles completely through the reservoir to another well.

The swelling of the PPG particles may be delayed for a period of 5 to 240 minutes to enhance the injectivity and allow the smaller, un-swollen particles to enter the reservoir through the perforations, if present. After the particles have left the wellbore and entered the reservoir, they will begin swelling and cause diversion and plugging. Depending upon the degree of swelling and the salinity of the adjacent brine, the particles may change shape and extrude through pores smaller than the unconfined swollen particle. This process will continue until the particles achieve a size too large for extrusion under the local pressure gradient. As the treatment fluid front extends further out from the producer well, the pressure gradient is expected to decrease as the local velocity also drops. This means less extrusion pressure is available and a point will be reached where the particles will no longer pass through the pore throat but stay near the pore throat and restrict the flow of fluid through that pore throat.

The differential pressure between the producing well where the injection of PPG is being done and the reservoir facilitates the deformation of the particles for deep injection and diversion. In contrast to injection well treatments where the differential pressure in an injector well may be from about 500 to about 2500 psi [3.45 to 17.3 MPa], most producing wells are more limited in the pressure that can be attained during a treatment. The differential pressure in a producing well may be from about 200 to about 1000 psi [1.4 to 6.9 MPa], although some exceptions will allow higher injection pressures. On the producing side, injection may be complicated by lower available differential pressures, the possibility of producing the particles when the well is returned to production as the pressures are then reversed, and the limited time available for the treatment to achieve a deep penetration where differential pressures due to flow are small. Under production, as the fluid flow approaches the producing well, pressure gradients rise and this fact may promote movement of the PPG particles towards the wellbore. In addition, PPG particles will encounter both water and oil in the treatment, whereas only water is normally encountered in injection well treatments, which may interfere with the rate of swelling. Finally, the brine that the treatment particles encounter can be a mixture of resident or connate brine and any injected or aquifer brine. On the injection side, the water injection has fully displaced all connate brine from the permeable channels so the brine environment is better known. As brine affects the swelling rate and extent of swelling, the information about the environment in which the particles are placed is important for predicting the rate and degree of swelling.

To achieve deep penetration of the particles and move them away from the critical region near the wellbore where high pressure gradients will exist during production operations, an overflush of fluid may be used. As used herein the term "overflush" is defined as a fluid that is devoid of particles and flushes the particles away from the wellbore at the end of a treatment. The volume of the overflush is designed to push the particle front away from the high pressure gradient area that exists around the wellbore during normal production. Typically the overflush should create a particle free zone out from 0.3 to 3 meters, preferably from 1 to 5 meters and more preferably from 1.5 to 7 meters from the wellbore. The overflush fluid can be brine, freshwater, water external emulsion or be non-aqueous, such as diesel, mineral oil, crude oil, oil-external emulsions containing a brine, non-aqueous fluids such as alcohols, mutual solvents or combinations thereof. When an emulsion is employed, the internal brine phase may be a freshwater to enhance the degree of swelling of the particles.

The composition of overflush fluids may help delay the swelling of the particles and enhance their ability to penetrate further into the reservoir before swelling and trapping occurs. As the PPG fluid encounters lower salinity brine in the rock, the particles will begin to swell and be harder to displace, eventually finding a spot where they can no longer be propagated. Similarly, a high salinity brine, such as a brine having a salt concentration of from about 1 to about 30 wt %, or 3 to about 10 wt % can delay swelling. As the brine is diluted by resident brines of lower salinity, the particles will show enhanced swelling. The flush fluids can be alternated from brine to non-aqueous fluid to reestablish oil saturation near the wellbore and enhance early production of the oil phase after the well is returned to production. The volume of overflush can be altered to achieve more or less penetration of the particles. The flush fluid can be a gradient in salinity from highly saline brine to fresh water, which enhances the penetration but later enhances the swelling of particles closest to the wellbore by a decrease in salinity. Alternatively, a water internal emulsion can be used to release freshwater that will enhance swelling.

The use of relative permeability modifiers (RPM), can reduce water permeability with little effect on oil permeability in porous media. The RPMs are not efficient in high permeability channels but can be used in the general matrix where permeability is much lower. The combination of PPG particles to control water in the channels and RPM to control water in the other pathways provides a dual approach for reducing water flow and enhancing oil rate. Examples of RPM may include water-soluble polymers such as polyvinyl polymers, polymethacrylamides, and their ammonium, alkali metal, and alkaline earth salts thereof. Further examples of suitable water soluble polymers include acrylic acid-acrylamide copolymers, acrylic acid-methacrylamide copolymers, polyacrylamides, partially hydrolyzed polyacrylamides, partially hydrolyzed polymethacrylamides, polyvinyl alcohol, polyalkyleneoxides, copolymers and terpolymers containing acrylamide, acrylic acid, acrylamide propane sulfonic acid (AMPS), vinyl pyrrolidone, maleic anhydrides or phosphate esters. Cationic copolymers with acrylamide and a cationic acrylamide are also employed as well as associative polymers, hydrophobically modified polymers and mixtures thereof.

The RPM may be present in an amount of from about 0.075% to about 2%, and from about 0.1% to about 0.5%, based upon the total weight of the treatment fluid.

For extremely permeable pathways, the inclusion of a crosslinker for the RPM can be used. Examples of suitable crosslinkers include zirconium IV, titanium or aluminum and/or other Group IV metals as well as chromium, cobalt, the lanthanide series of metals and organic crosslinkers. Other suitable crosslinkers can contain boron. The metal ions may be provided by any compound that is capable of producing one or more of these ions. Examples of such compounds include zirconyl chloride, zirconium sulfate, zirconium lactate, chromium acetate, and triethanol titanate. Various ligands can be used to delay the release of the metal to cause crosslinking and their selection is dictated by the reservoir temperature and amount of delay required. Suitable ligands include amino acids, amines, alcohols, and other organic acids. Examples of ligands include acetate, lactate, glutarate, glutamate, propionate, citrate, glycolate, malonate, triethanolamine, tartarate, oxalate, bicine, aspartate, serine, B-alanine, alanine, sorbitol, xylitol, phosphonacetate, succinate and maleate. One or more mixtures of the above ligands may be used as well.

The RPM can be added to the PPG particles and delivered as a non-aqueous slurry, which delays the action of the RPM until it hydrates in resident brine within the formation. For example, a slurry of 0.2 to 1.5% PPG and 0.075 to 2% RPM in mineral oil or diesel could be used. Further additives such as organophilic clays or suspending agents can also be included to maintain the slurry homogeneity and prevent settling of the PPG or RPM particles. Alternatively, the RPM could be hydrated in the brine used to displace the PPG slug, for example in the overflush, described in more detail above. From 0.25 to 1% of RPM can be dissolved in the brine before injection as the overflush.

To help prevent the flowback of the particles during production, especially in the near-wellbore region where pressure gradients are higher, the present inventors present the following options for addressing this issue. First, one may follow the injection of the PPG particles with a capping fluid. The cap fluid can be a water soluble polymer with substantial viscosity, a heavy oil with viscosity, a gelant that becomes gelled in the near-wellbore region, or fibers that are known in the art to prevent particle flow. Further, one can use a freshwater to enhance the swelling ratio. Finally, the well can be placed on production in a scheduled manner to prevent sudden increases in pressure gradient that could dislodge the particles and initiate their flow. The initial production rate would be 10% of the pre-treatment rate and gradually increased to the desired rate in 10% increments with daily or hourly changes.

Examples of water-soluble polymers that may be suitable for the methods of the present disclosure include polyvinyl polymers, polymethacrylamides, cellulose ethers, lignosulfonates, and their ammonium, alkali metal, and alkaline earth salts thereof. Further examples of other suitable water soluble polymers include acrylic acid-acrylamide copolymers, acrylic acid-methacrylamide copolymers, polyacrylamides, partially hydrolyzed polyacrylamides, partially hydrolyzed polymethacrylamides, polyvinyl alcohol, polyalkyleneoxides, other galactomannans, heteropolysaccharides obtained by the fermentation of starch-derived sugar and their ammonium and alkali metal salts thereof. Suitable examples of biopolymers include gellan, K-carrageenan, sodium alginate, gelatin, agar, agarose, maltodextrin, chitosan, and combinations thereof. Additional examples of biopolymers are described in U.S. Pat. Nos. 5,726,138 and 7,169,427, and U.S. Patent Application Pub. No. 2005/0042192, the disclosure of each of which is incorporated by reference herein in its entirety.

Examples of heavy oils include crude oils with an API gravity of less than 20 degrees having a viscosity at ambient temperature of at least 50 cP, heavy mineral oils with a viscosity of 100 cP or more, refined products such as brightstock, or synthetic oils such as the silicone oils, olefin and paraffinic oils and the like.

Examples of gelants may include partially hydrolyzed polyacrylamides, polyvinyl alcohol, polyacrylamides, acrylic acid-acrylamide copolymers, copolymers and terpolymers containing acrylamide, acrylic acid, acrylamide propane sulfonic acid (AMPS), vinyl pyrrolidone, maleic anhydrides or phosphate esters and cationic copolymers with acrylamide and a cationic acrylamide These linear gels can be crosslinked with metal ions or organic crosslinkers.

Examples of fibers include any fibrous material, such as, for example, natural organic fibers, comminuted plant materials, synthetic polymer fibers (by non-limiting example polyester, polyaramide, polyamide, novoloid or a novoloid-type polymer), fibrillated synthetic organic fibers, ceramic fibers, inorganic fibers, metal fibers, metal filaments, carbon fibers, glass fibers, ceramic fibers, natural polymer fibers, and any mixtures thereof. Particularly useful fibers are polyester fibers coated to be highly hydrophilic, such as, but not limited to, DACRON polyethylene terephthalate (PET) Fibers available from Invista Corp. Wichita, Kans., USA, 67220. Other examples of useful fibers include, but are not limited to, polylactic acid polyester fibers, polyglycolic acid polyester fibers, polyvinyl alcohol fibers, and the like.

The treatment described herein is expected to decrease the WOR as well as boost hydrocarbon production. Typically, the WOR can be reduced from about 99% to about 25%, such as, for example, from about 90% to about 50%, or from about 90% to about 75%. As a result, the production of hydrocarbons from the producing well may be increased by a factor of about 2 to about 10, such as, for example, from about 2 to about 5.

Figure 2:
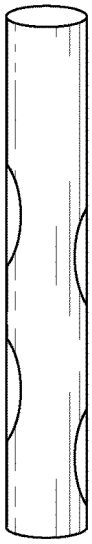
FIG. 2. is a graphical representation of a bottomhole tubing with multi-ports for injection.

The injection of the slurry can be facilitated by use of coiled tubing which can also include a fiber optic cable that measures the downhole temperatures and pressures and can provide a flow injection profile. The system can be equipped with selective packers for isolation, by using multi-port tubing as illustrated below in FIG. 2. Isolation is optional. The fluid can also be bullheaded through casing or use a sealbore configuration.

The foregoing may be better understood by reference to the following examples, which are presented for purposes of illustration and are not intended to limit the scope of the present disclosure.

EXAMPLE 1

A treatment design. The producing well is in a reservoir with an average permeability of 3 Darcy and a permeability variation of 0.8 as measured by the Dykstra Parsons technique (very heterogeneous). The reservoir has a natural aquifer which maintains reservoir pressure and no injection wells exist. The well is a cased hole, cemented completion with perforations in a 3 meter zone of 6 shots per foot. Production was initially 1100 barrels per day (bpd) of liquid and the water cut was 15% with a WOR of 0.17. Production dropped to about 800 bpd of oil and 200 bpd of brine (WOR=0.25) after two years of production when the water cut increased to 70% and total liquids dropped to 600 bpd over a month's time for a WOR of 2.33.

A treatment to control the water production and lower the WOR is designed. A brine containing 20 wt % sodium chloride and with an average PPG concentration of 0.4 vol % is injected for thirteen hours at a rate of 1030 bpd. The PPG concentration varied from a beginning concentration of 1.2 vol % to a final concentration of 0.2 vol % and is followed by an overflush of 60 barrels of freshwater containing an RPM at 0.25 wt % in the first 50 barrels and just fresh water in the last ten barrels. The PPG is injected into the water stream entering the tubing by using a slurry of the PPG in a mineral oil. This slurry has a 30 minute delay of swelling when added to freshwater at 25° C. Following injection of the overflush, the well is shutin overnight to allow the PPG particles to swell. The well is returned to production at 200 bpd and the rate increased in 200 bpd increments every 4 hours until a rate of 800 bpd is achieved. The WOR is measured at 0.25 at a rate of 800 bpd, indicating the success of the treatment in reducing water and enhancing oil production.

Although the preceding description has been described herein with reference to particular means, materials and embodiments, it is not intended to be limited to the particulars disclosed herein; rather, it extends to all functionally equivalent structures, methods and uses, such as are within the scope of the appended claims. Furthermore, although only a few example embodiments have been described in detail above, those skilled in the art will readily appreciate that many modifications are possible in the example embodiments without materially departing from the disclosure of SWELLABLE POLYMER PARTICLES FOR PRODUCING WELL TREATMENTS. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112(f) for any limitations of any of the claims herein, except for those in which the claim expressly uses the words 'means for' together with an associated function.

What is claimed is:

1. A method of treating a subterranean formation, the method comprising:

introducing a treatment fluid to a producing wellbore of a producing well of the subterranean formation from a surface above the subterranean formation and through one or more of the following: a production tubing of the producing well, a coiled tubing located in the producing well, and an annulus formed between the production tubing and the producing wellbore, wherein the subterranean formation comprises a low permeability zone and at least one high permeability zone having higher permeability than the low permeability zone, the treatment fluid comprised of at least PPG particles to at least partially plug the high permeability zone to enhance the oil rate and reduce the water rate of the producing well.

2. The method of claim 1, wherein the treatment fluid further comprises a relative permeability modifier (RPM) to modify the permeability of the low permeability zone to enhance the oil rate and reduce the water rate produced from the low permeability zone.

3. The method of claim 2, wherein the treatment fluid further comprises a delayed crosslinker.

4. The method of claim 1, wherein the treatment fluid is a slurry that includes a non-aqueous fluid that effectively delays the swelling of the PPG particles while allowing for deeper penetration of the PPG particles into the reservoir.

5. The method of claim 1, wherein the method further comprises adding a brine or salt to increase the salinity of the treatment fluid such that the swelling of the PPG is delayed.

6. The method of claim 1, the method further comprising introducing an overflush to displace the PPG particles away from the producing wellbore.

7. The method of claim 6, wherein the overflush is a brine, a series of salinity graded brines, an oil external emulsion of a freshwater, or non-aqueous fluids.

8. The method of claim 6, wherein the overflush comprises an RPM.

9. The method of claim 6, wherein the overflush comprises an RPM and a delayed crosslinker.

10. The method of claim 6, wherein the method comprises adding a cap of gel, water soluble polymer, fibers, or a low salinity brine to inhibit the back production of the PPG particles when the producing well is returned to production.

* * * * *